United States Patent [19]

Marcotti

[11] Patent Number: 4,601,255

[45] Date of Patent: Jul. 22, 1986

[54] FLAGPOLE DEVICE

[76] Inventor: Ettore Marcotti, 28 Cleveland Pl., Palisades Park, N.J. 07650

[21] Appl. No.: 644,352

[22] Filed: Aug. 27, 1984

[51] Int. Cl.[4] ..... G09F 17/00

[52] U.S. Cl. ..... 116/173; 116/28 R; 40/591; 206/45.33

[58] Field of Search ..... 116/173, 28 R; 206/45.33; 40/591; 283/56; 281/5

[56] References Cited

U.S. PATENT DOCUMENTS

| | | | |
|---|---|---|---|
| 1,804,293 | 5/1931 | Warzoha | 116/173 |
| 2,168,484 | 8/1939 | Loux | 116/173 |
| 2,909.147 | 10/1959 | Crowder | 116/173 |
| 3,757,937 | 9/1973 | Weinstein | 206/45.33 |
| 3,983,277 | 9/1976 | Ackerman | 206/45.33 |

*Primary Examiner*—Charles Frankfort
*Assistant Examiner*—Denis E. Corr
*Attorney, Agent, or Firm*—Collard, Roe & Galgano

[57] ABSTRACT

A signal flag or pennant for use at sporting events consisting of an elongated flag staff on which is attached a hollow transparent flat envelope such as a plastic envelope into which is inserted a flag or pennant. A semi-circular spring-loaded clip having a diameter slightly smaller than the flag staff frictionally retains the plastic envelope to the staff. The flag or pennant can be removed at will from the plastic envelope and different flags or pennants can be inserted, depending upon the sporting event attended. The plastic envelope prevents rain or moisture from damaging the flag or pennant during its use.

2 Claims, 5 Drawing Figures

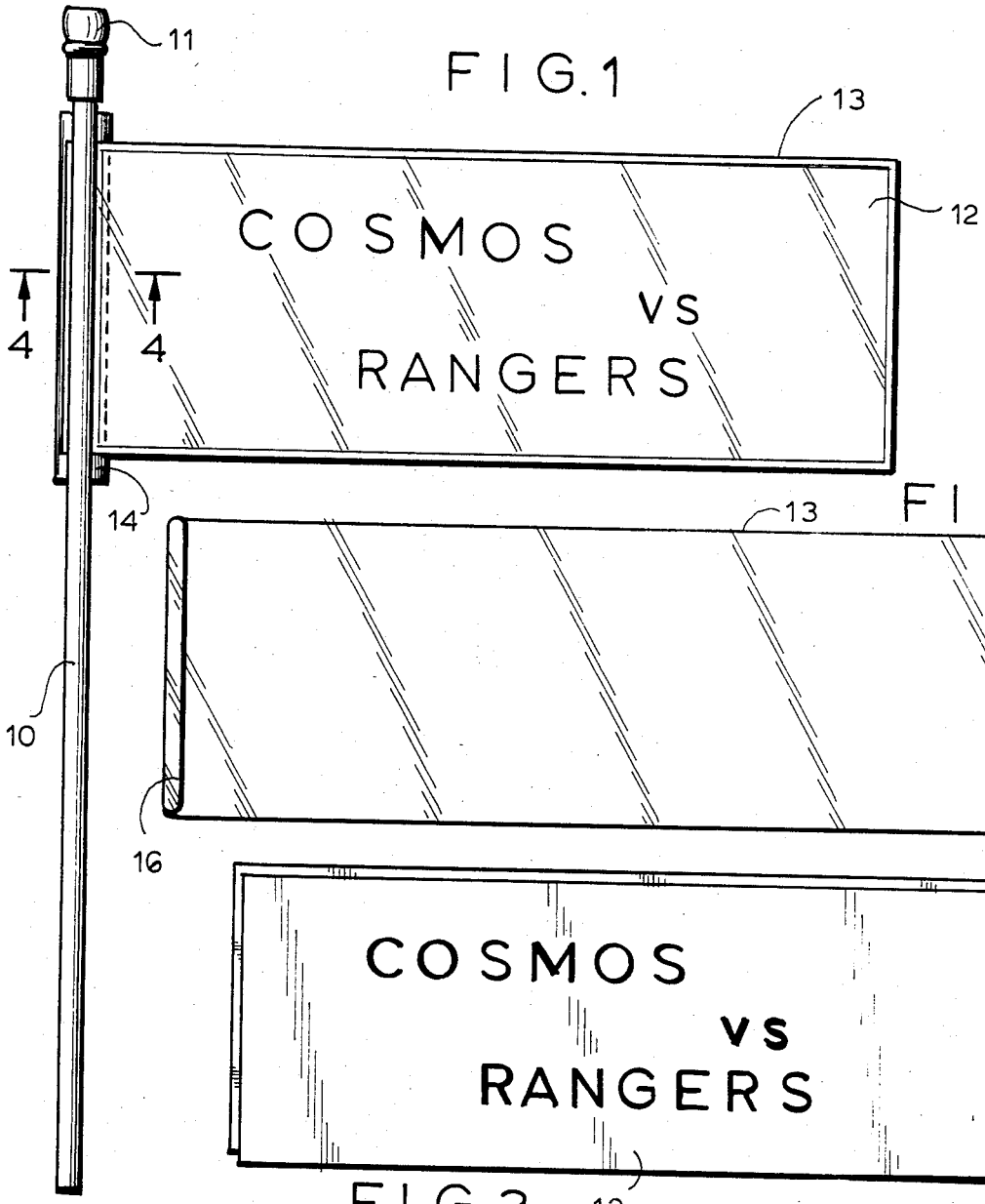
FIG. 1
FIG. 2
FIG. 3
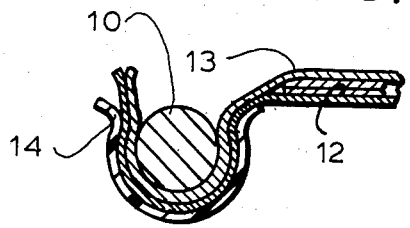
FIG. 4
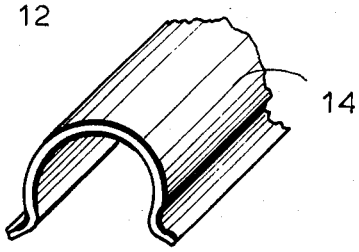
FIG. 5

FLAGPOLE DEVICE

This invention relates to flags and pennants and to a method of making such flags which are generally used at sporting events and sold as souvenirs by vendors to sporting fans.

The device of the present invention consists of an elongated rod or tubular staff which is preferably constructed of a wood dowl. Near one end of the staff is provided a flexible clip which frictionally fits over the end of the staff and engages a printed flag or indicator which forms the souvenir of the sporting event. The flag portion of the invention preferably consists of a printed or decorated banner or pennant which is inserted into a plastic transparent envelope so that the ends of the transparent plastic envelope fit into the clip and is retained at one end of the flag staff. The flag itself is preferably in the form of a bumper sticker so that after the sporting event is over, the flag can be removed from the plastic envelope and applied to a flat wall surface such as the bumper of a vehicle.

Flags used at sporting events are generally old in the art as described by U.S. Pat. Nos. 2,909,147; 3,127,869; 3,217,690; 3,219,010; and 3,636,912. These prior art patents generally describe the use of souvenir flags and different means for attaching them to the flagpole. None of the devices of the prior art patents however discuss the possibility of displaying the flag through a plastic envelope and having the ability to reuse the flag or change the flag for different sporting events. The present invention has the advantage over the prior art in allowing the user or the manufacturer of the flag to insert different flags for different sporting events onto the flag staffs in the event that the souvenir signal flag cannot be used for a particular event. Moreover, it has the advantage over prior art pennants in that the flag is waterproof, and no glue or staples are required to fasten the flag to the pole or staff.

It is therefore an object according to the present invention to provide a souvenir signal flag consisting of a flag staff and a flag disposed in a transparent envelope and removably connected to the flag staff.

It is another object according to the present invention to provide a signal flag which is simple in design, easy to manufacture and inexpensive in cost.

Other objects and features of the present invention will become apparent from the following detailed description considered in connection with the accompanying drawings which disclose the embodiments of the invention.

In the drawings, wherein similar reference characters denote similar elements throughout the several views:

FIG. 1 is a perspective view showing the signal flag and staff according to the present invention;

FIG. 2 is a detailed view showing the transparent envelope of the flag holder;

FIG. 3 is a detailed view showing the flag which is insertable into the envelope of FIG. 2;

FIG. 4 is a cross-sectional view taken through section 4—4 of FIG. 1; and FIG. 5 is a detailed view of the clip holder.

Referring to all of the FIGS., there is shown the signal flag or pennant 12 mounted on a staff 10, and having a cap 11 at one end thereof. A flexible clip 14 which removably snaps onto the surface of the staff 10 secures a transparent envelope 13 onto the staff. Inserted into the open end 16 of envelope 13 is a souvenir flag 12 which is preferably in the form of a bumper sticker which has been folded in half so that the printed portion of the flag is visible from both sides of transparent envelope 13. The envelope is preferably constructed of cellophane, transparent plastic, or other flexible transparent material and sealed at its end 15 as well as along its edges. It is open at one end 16 which is preferably the end secured to staff 10. A flexible spring clip 14 which has a circular diameter slightly smaller than the diameter of staff 10 is snapped onto one end of staff 10, preferably adjacent to end 11 so that it encompasses and seals opening 16 of transparent envelope 13. Spring clip 14 which may be constructed of metal or plastic is designed to preferably encompass more than half the diameter of staff 10. These clips are known in the art as described in U.S. Pat. No. 3,219,010.

In order to assemble the flag of the present invention, flag 12 which has been folded in half to show its design on both surfaces is inserted into opening 16 of transparent envelope 13. Transparent envelope 13 is preferably slightly larger than the folded version of flag 12. The opening end of envelope 13 is preferably provided with an additional selvage so that it can be clamped around most of the diameter of clip 14 when the clip is snapped onto staff 10. Clip 14 is preferably equal to or slightly longer than the edge of envelope 13 so that it can encompass and secure the envelope along its entire width on the staff 10. Souvenir flag 12 can be easily removed from the signal flag by unsnapping clip 14 from the staff and sliding the flag out of envelope 16. It is thus possible to reuse the staff and the transparent envelope by purchasing a new flag at the game and inserting it into transparent envelope 13.

Souvenir flag or pennant 12 is preferably a bumper sticker in which the text or display portion is printed along its entire length so that when the sticker or flag is folded in half, both sides of the display are visible. It can later be removed from the plastic envelope and used on the bumper of a car.

Staff 10 is preferably constructed of wooden dowl, ¼ inch in diameter, and 12 inches in length topped by a plastic colorful cap. It may also be a plastic tube or solid shaft.

While only a few embodiments of the invention have been shown and described, it will be obvious that many modifications may be made thereunto, without departing from the spirit and scope of the invention.

What is claimed is:

1. A signal flag comprising:

an elongated flag staff having a plastic cap at one end thereof and having a circular cross-section;

an elongated hollow transparent flat generally waterproof envelope made of a plastic material and having a width smaller than the length of the flag staff and open at one end thereof;

a flag comprising a bumper sticker removably inserted into said envelope, said bumper sticker having printed matter on one side thereof, all of which may be seen when said bumper sticker is contained within said envelope and said bumper sticker having adhesive material on the opposite side thereof to allow the bumper sticker when removed from said envelope to be applied to a vehicle; and a semicircular spring-loaded removable plastic clip having a diameter slightly smaller than said staff releasably clamping the open end of said transparent envelope in a sealed manner to said staff adjacent to said cap thereof.

2. The signal flag as recited in claim 1, wherein said staff comprises a wood cylindrical dowl.

* * * * *